United States Patent [19]

Kaneko et al.

[11] 4,375,031

[45] Feb. 22, 1983

[54] METHOD AND DEVICE FOR MEASURING A DEGREE OF EXHAUSTION OF PHOTOGRAPHIC PROCESSING SOLUTIONS

[75] Inventors: Yujiro Kaneko; Hiroshi Fujisaki, both of Tokyo, Japan

[73] Assignee: Fuji Photo Film Co., Ltd., Kanagawa, Japan

[21] Appl. No.: 239,927

[22] Filed: Mar. 3, 1981

[30] Foreign Application Priority Data

Mar. 6, 1980 [JP] Japan ..... 55-29690[U]

[51] Int. Cl.[3] ..... G06C 3/00; G03C 1/00

[52] U.S. Cl. ..... 235/64.7; 116/321; 235/89 R; 356/404

[58] Field of Search ..... 116/321; 430/30, 264; 356/422, 423, 404; 235/64.7 X

[56] References Cited

U.S. PATENT DOCUMENTS

| | | | |
|---|---|---|---|
| 1,566,046 | 12/1925 | Sleight | 356/422 |
| 2,240,053 | 4/1941 | Richardson | 356/423 |
| 2,286,780 | 6/1942 | Yule | 356/422 X |
| 2,370,683 | 3/1945 | Palma | 356/422 X |
| 2,380,244 | 7/1945 | Jones et al. | 235/64.7 X |
| 3,685,726 | 8/1972 | Wada et al. | 235/64.7 |
| 3,685,900 | 8/1972 | Kirby et al. | 356/423 X |
| 4,059,357 | 11/1977 | Klein | 356/243 |
| 4,259,423 | 3/1981 | Merlo | 430/30 |

FOREIGN PATENT DOCUMENTS

| | | | |
|---|---|---|---|
| 941520 | 4/1956 | Fed. Rep. of Germany | 73/64 |

*Primary Examiner*—Daniel M. Yasich

*Attorney, Agent, or Firm*—Sughrue, Mion, Zinn Macpeak and Seas

[57] ABSTRACT

An exhaustion degree measuring board for measuring the fatigue of photographic processing solutions including a base member having at least one reference density window formed therein along with graduated scales corresponding to a control strip. The reference density windows have upper and lower portions with the upper portion being transparent for viewing the relevant part of the control strip and the lower part of at least one of the windows having a varying dot density. A center line with a reference mark is formed on the base for alignment with the control strip.

11 Claims, 2 Drawing Figures

METHOD AND DEVICE FOR MEASURING A DEGREE OF EXHAUSTION OF PHOTOGRAPHIC PROCESSING SOLUTIONS

BACKGROUND OF THE INVENTION

The present invention relates to a method and device for measuring a degree of exhaustion of photographic processing solutions. The degree of exhaustion of the photographic processing solution can be readily measured with the aid of a photographic strip which is obtained through a developing process, hereinafter referred to as "a control strip" when applicable.

Heretofore, in measuring the degree of exhaustion of a photographic processing solution, a method has been employed in which the control strip is developed with the photographic processing solution to be measured. The control strip is then subjected to density measurement with a measuring device such as a densitometer to measure photographic characteristics from which the degree of exhaustion of the processing solution is detected.

However, the conventional method suffers from difficulties in that it is necessary to use an expensive density measuring device and density measurement takes a great deal of effort and time. Furthermore, the conventional method is disadvantageous in work efficiency because the density measuring device must usually be located outside the developing room.

Accordingly, an object of the invention is to provide an exhaustion degree measuring board for photographic processing solutions in which all of the above-described difficulties accompanying a conventional exhaustion degree measuring method have been eliminated.

More specifically, an object of the invention is to provide an exhaustion degree measuring board for photographic processing solutions with which the degree of exhaustion of a developing solution can be readily and visually measured, without using a densitometer, from a control strip which is used for controlling the characteristics of developing solutions for ordinary monochromatic photosensitive materials and color photosensitive materials.

A second object of the invention is to provide an exhaustion degree measuring board for photographic processing solutions which can be manufactured readily and at low cost.

SUMMARY OF THE INVENTION

Provided according to the invention is an exhaustion degree measuring board for photographic processing solutions which, according to the invention, has at least one reference density window therein which is composed of a reference density part for comparison and a part adjacent thereto through which a specimen can be viewed to thereby measure the degree of exhaustion of a photographic processing solution.

In the case where only one reference density window is provided in the measuring board, the exhaustion characteristic A of a photographic processing solution can be obtained by using a scale on the control strip and the one reference density window. On the other hand, another exhaustion characteristic B can be obtained by using, for comparison, two reference density windows which have different densities and a scale on the control strip or a scale on the exhaustion degree measuring board. The exhaustion characteristic A is a parameter corresponding to a so-called "sensitivity", and the exhaustion characteristic B is a parameter corresponding to a so-called "gradation". The part of the reference density window through which the specimen can be viewed may be either transparent or white.

The exhaustion degree measuring board according to the invention, having a center line and a point (or a base point) in addition to the reference density windows and the scale according to the use to which the board is put, is convenient in practical use.

Thus, exhaustion of the processing solution can be corrected for by applying a necessary component or components thereto according to the exhaustion characteristics thus obtained.

In this connection, if both exhaustion characteristics are available, then the exhaustion of the processing solution can be positively corrected for.

DESCRIPTION OF THE PREFERRED EMBODIMENTS

An example of the exhaustion degree measuring board according to the invention will be described with reference to the case where the measuring board is used with the control strip which is employed for controlling a lith type film developing solution in the field of manufacturing printing plates.

Figure 1:
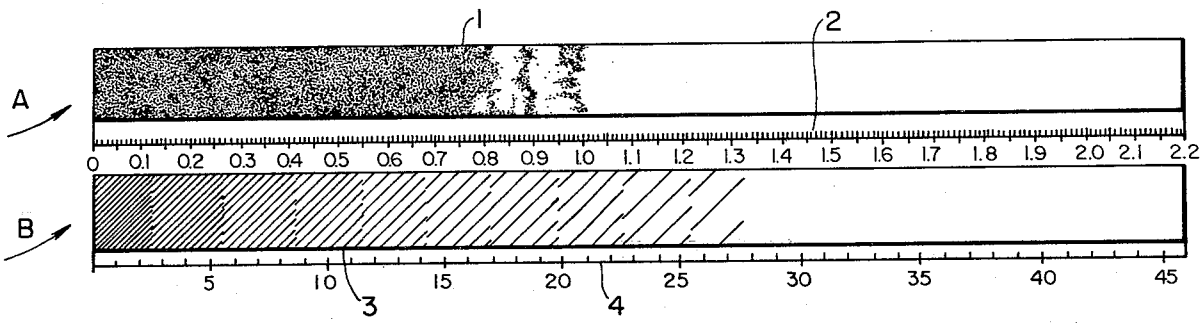
FIG. 1 is a plan view of a control strip used with a exhaustion degree measuring board for determining a degree of exhaustion of a photographic processing solution according to the invention.

FIG. 1 is a plan view of the control strip which has been developed in the developing solution to be tested. The control strip is also made up of a part A and a part B. The part A includes a strip 1, the density of which varies continuously, and a transparent scale 2 for obtaining an exhaustion characteristic A (hereinafter referred to as "a value A"). The part B includes a strip 3 having a number of dots (halftone dots), the density of which is varied stepwise, and a scale 4 for obtaining an exhaustion characteristic B (hereinafter referred to as "a value B", when applicable).

Figure 2:
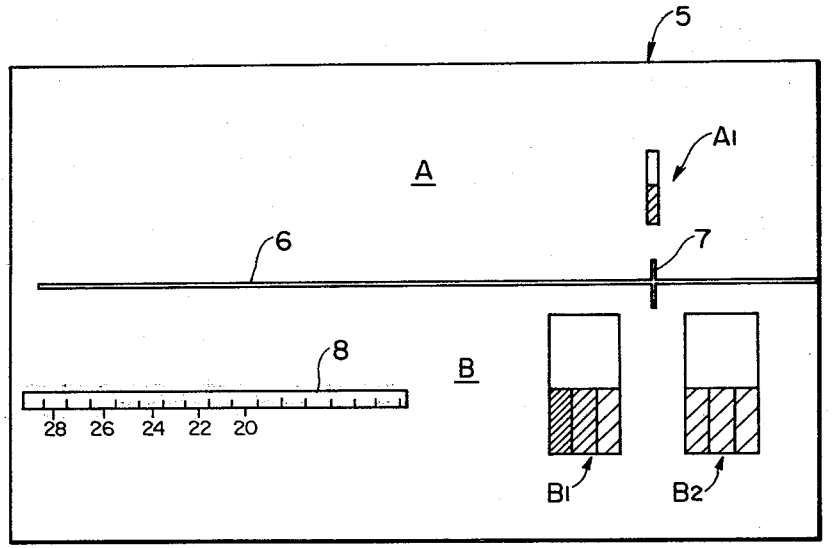
FIG. 2 is a plan view showing the exhaustion degree measuring board 5 according to the invention.

FIG. 2 is a plan view of the exhaustion degree measuring board according to the invention. The measuring board 5 is formed from a polyester base lith type film. More specifically, the measuring board 5 is manufactured by printing and developing an original image on the lith type film. The measuring board 5 has three reference density windows $A_1$, $B_1$ and $B_2$, a center line 6, a reference mark 7 on the center line, and a scale 8 used for measurements, all of which are formed in white on a black base. The window $A_1$ is divided into two parts of equal length, namely, an upper part and a lower part. The lower part of the window $A_1$ has a density of 1.5 and the upper part is transparent. Each of the windows $B_1$ and $B_2$ is divided into two equal parts, namely, an upper part and a lower part. The upper part of each of the windows $B_1$ and $B_2$ is transparent while the lower part is formed as a dot window for comparison and determination. Each dot window is further divided into three sub-parts.

The central sub-part of the lower part of the window $B_1$ has a reference dot density percentage of 95% while the density dot percentages of the left-hand part and the right-hand part are smaller than 95% and larger than 95%, respectively. The size of these dots is made equal to that of the dots in the control strip. The window $B_2$ is formed similar to the window $B_1$ except that the reference density dot percentage is 10%.

The center line 6 is a reference line which is used when the control strip is placed on the measuring board. The center line reference mark 7 is used to read a measurement value determined using the window $A_1$.

The scale 8 is used to quickly read dot gradations. More specifically, with the scale 8, the difference between data which is obtained with the control strip (a value B) can be directly read upon the scale.

An example of a method of using the measuring board of the invention will be described.

I. Value A Measuring Method

1. The measuring board 5 is placed on a light table and is secured thereto with tape.

2. The control strip 1 is placed under the measuring board in such a manner that the scale 2 is in alignment with the center line 6 of the measuring board.

3. Under this condition with the scale 2 aligned with the center line 6, the control strip is slid horizontally until the density of the lower part of the window $A_1$ is visually found to be equal to a density of the strip 1.

4. Under this condition, the mark on the scale 2 which appears in the center line reference mark 7 of the measuring board is read to obtain the value A of the strip 1.

II. Value B Measuring Method

1. Similarly as in the measurement of the value A, with the center line 6 aligned with the scale 2, the control strip is slid horizontally until a dot of the strip 3 is visually found to be closest to a dot size (density) of the lower part of the window $B_1$.

2. Under this condition, the step member of the central part in the lower part of the window $B_1$ is read on the scale 4 of the control strip and the position of the step number thus read is marked.

3. Similarly as in the case of the window $B_1$, the control strip is slid horizontally until a dot of the strip 3 is visually found to be closest to a dot size (density) of the lower part of the window $B_2$.

4. Under this condition, the step number on the scale 8 which is indicated by the position marked in step 2 is read. This value is the desired value B.

In the exhaustion degree measuring board of the invention as described above, three reference density windows are provided. However, it is possible to impart the function of the window $A_1$ to the window $B_1$ or $B_2$ to obtain the value A. In this case, the number of reference density windows formed in the measuring board is only two.

In the above-described embodiment of a measuring board of the invention, the density part of one of the reference density windows has a constant density while the density parts of the remaining windows is stepwise changed in density. However, it should be noted that the density parts are not limited thereto or thereby. That is, the density parts may have a number of dots of constant density or which are varied continuously in density in conformance with a control strip to be used.

If the density parts are black, they can be used for a control strip which is made of a monochromatic photosensitive material other than a lith type photosensitive material. Furthermore, if the density parts are colored cyan, magenta or yellow, they can be similarly used for a control strip made of a color sensitive material to obtain the values A and B. The densities of the density parts can be determined as desired according to the ranges of the values A and B to be obtained.

With the fatigue degree measuring board according to the invention, the value B can be obtained without using the scale 8. That is, the value B can be obtained from the difference between the step numbers which are read on the control strip through the windows $B_1$ and $B_2$, respectively. The strip for obtaining the value B may have a density which is continuously varied. That is, if a measuring board the density parts of the reference density windows of which have continuously varied densities is used, as in the above-described embodiment, the value B can be readily obtained from the strip or the scale on the measuring board.

The material of the exhaustion degree measuring board described above has a polyester base. However, it should be noted that the material is not limited thereto or thereby. That is, even an exhaustion degree measuring board which is manufactured by providing the reference density windows, scales, point, etc. as required on a transparent base or a support such as a sheet of paper can be effectively used.

With the exhaustion degree measuring board according to the invention, the degree of exhaustion of a photographic processing solution or, if desired, two different exhaustion characteristics can be readily obtained from various control strips.

The exhaustion degree measuring board of the invention can be produced at a much lower price than the more expensive prior art device. As the measuring board can be made quite small, the measurement can be carried out at any desired location.

A preferred embodiment of the invention, namely a board for measuring the degree of exhaustion of a photographic processing solution, using a control strip which has scales to obtain a exhaustion characteristic B, may include a value A measuring reference density window having a reference density part for comparison and a part adjacent thereto through which a specimen can be viewed, two value B measuring reference density windows each having reference density parts for comparison which have different densities and a part adjacent thereto through which the specimen can be seen, and a value B measuring scale. The two value B measuring reference density windows and the scale are arranged in a straight line so as to readily measure the value B.

What is claimed is:

1. An exhaustion degree measuring device for determining a degree of exhaustion of a photographic processing solution, comprising:

a photographic strip, said strip having first and second strip parts which have been previously exposed to said processing solution, said first and second strip parts having first and second variable densities, respectively, along a length thereof, said strip having first and second scales adjacent said first and second strip parts; and a measuring board, said board having a base member having first and second reference density windows therein, said first and second reference density windows having first and second reference density parts and first and second transparent parts adjacent thereto, respectively, said first reference density part having a first predetermined reference density, a middle section of said second reference density part having a second predetermined reference density; whereby said first strip part is placed under said first transparent part of said first reference density window and said first strip part is moved relative thereto until a first portion of said first strip part having a density equal to said predetermined reference density of said first reference density part is adjacent said first reference density part, a first value indicative of said degree of exhaustion of said photographic processing solution being indicated by a point on said first scale adjacent said first portion of said first strip part; further whereby said second strip part is placed under said second transparent part of said second window and moved relative thereto until a second portion of said second strip part having a density equal to said second predetermined reference density is adjacent said middle section of said second reference density part so that a second value on said second scale adjacent said second portion can be determined.

2. The device claimed in claim 1 wherein said base member of said board has a third reference density window therein, said third window having a third reference density part and a third transparent part adjacent thereto, a middle section of said third reference density part having a third predetermined reference density; whereby said second strip part is placed under said third transparent part of said third window and moved relative thereto until a third portion of said second strip part having a density equal to said third predetermined reference density is adjacent said middle section of said third reference density part so that a third value on said second scale adjacent said third portion can be determined, said third value also being indicative of said degree of exhaustion of said processing solution.

3. The device claimed in claim 2 wherein said second and third reference density parts of said second and third windows have a non-uniform dot density which varies in a stepwise manner along a length of said second and third reference density parts.

4. The device claimed in claim 3 wherein said second and third values are subtracted to determine said degree of exhaustion of said processing solution.

5. The device claimed in claim 4, wherein said board has a third scale for subtracting said second and third values.

6. The device claimed in claim 1, 2, 3, 4 or 5 wherein said board has a center line along a length thereof for aligning said strip and said board, said center line having a reference mark thereon for indicating said first value.

7. The device claimed in claim 2 wherein said first predetermined density of said first reference density part of said first reference density window has a density of about 1.5.

8. The device claimed in claim 7 wherein said middle section of said second predetermined reference density part has about a 95 percent dot density, and said middle section of said third predetermined reference density part has about a 10 percent dot density.

9. A method of determining a degree of exhaustion of a photographic processing solution, comprising the steps of:

exposing a photographic strip to said photographic processing solution, said strip having first and second strip parts and first and second scales adjacent said first and second strip parts;

developing said exposed photographic strip so that said first and second strip parts have first and second variable densities along a length thereof;

superimposing a measuring board over said developed photographic strip, said measuring board having a base member having first and second reference density windows therein, said first and second reference density windows having first and second reference density parts and first and second transparent parts adjacent thereto, respectively, said first reference density part having a first predetermined reference density, a middle section of said second reference density part having a second predetermined reference density;

moving said first strip part relative to said first reference density window until a first portion of said first strip part having a density equal to said predetermined reference density of said first reference density part is adjacent said first reference density part;

noting a first value indicative of said degree of exhaustion of said photographic processing solution on a first point on said first scale adjacent said first portion of said first strip part;

moving said second strip part relative to said second window until a second portion of said second strip part having a density equal to said second predetermined reference density is adjacent said middle section of said second reference density part; and noting a second value on said second scale adjacent said second portion of said second strip.

10. The method claimed in claim 9 further comprising the steps of:

moving said second strip part relative to a third transparent part of a third window of said board until a third portion of said second strip part has a density equal to a third predetermined reference density which is equal to a density of a middle section of a reference density part of said third window; and noting a third value on said second scale adjacent said third portion.

11. The method claimed in claim 10 further comprising the step of subtracting said second and third values.

* * * * *